United States Patent [19]

Cobos

[11] 4,194,688

[45] Mar. 25, 1980

[54] METHOD OF AND APPARATUS FOR PROVIDING SUPPLEMENTAL HEAT TO BUILDINGS

[76] Inventor: Charles R. Cobos, 4500 Elaine St., Bryan, Tex. 77801

[21] Appl. No.: 885,315

[22] Filed: Mar. 10, 1978

[51] Int. Cl.[2] ..... F24D 5/00; F24H 3/02

[52] U.S. Cl. ..... 237/53; 237/55; 126/121; 126/110 R; 126/112; 126/146

[58] Field of Search ..... 98/94 AC; 237/50, 51, 237/53, 55, 81; 126/120, 121, 99 R, 141, 110 R, 112, 146

[56] References Cited

U.S. PATENT DOCUMENTS

| | | | |
|---|---|---|---|
| 184,201 | 11/1876 | Trench | 237/50 |
| 2,355,495 | 8/1944 | Zier, Jr. | 126/110 R |
| 2,703,567 | 3/1955 | Manchester et al. | 126/121 |
| 2,879,762 | 3/1959 | Robson | 126/110 R |
| 3,685,506 | 8/1972 | Mouat | 126/121 |
| 3,889,653 | 6/1975 | Scogin | 126/110 R |
| 3,994,275 | 11/1976 | Williams | 126/141 |
| 4,003,362 | 1/1977 | Lener | 126/288 |
| 4,004,731 | 1/1977 | Zung | 126/121 |
| 4,081,915 | 4/1978 | Babcerowicz et al. | 34/235 |
| 4,112,281 | 9/1978 | Epps | 126/101 |
| 4,138,985 | 2/1979 | Marley | 237/50 |

*Primary Examiner*—Henry C. Yuen

[57] ABSTRACT

The method disclosed includes positioning a furnace disposed within a shelter outside near the building, the shelter has an inlet for receiving ambient air and an outlet for passing air heated by the furnace out of the shelter. An air duct is mounted between the shelter and an opening into the building. A solid fuel is burned within the furnace to heat the air within the shelter and the heated air is transported through the duct into the building to provide supplemental heat in the event the supply of fluid fuel is interrupted.

The apparatus disclosed includes a shelter having walls with an inlet for receiving ambient air and an outlet for passing heated air out of the shelter. A furnace is disposed within the shelter for heating the air and includes a grate for supporting solid fuel to be burned and an exhaust stack extending through the walls of the shelter for carrying exhaust gases from the furnace without mixing with the air within the shelter. A duct is adapted to the mounting between the shelter and an opening into the building and the heated air passes through the outlet of the shelter and carried through the duct into the building to supply heat to the building in the event the fluid fuel supply is interrupted.

1 Claim, 2 Drawing Figures

METHOD OF AND APPARATUS FOR PROVIDING SUPPLEMENTAL HEAT TO BUILDINGS

BACKGROUND AND BRIEF SUMMARY OF THE INVENTION

It is well known that a vast number of buildings are heated with fluid fuels, such as natural gas and fuel oil. Moreover, the supply of these fluid fuels to the buildings are sometimes interrupted because of cold weather and inadequate quantities of the fuels available.

One solution to this lack of heat is the burning of available solid fuels, such as coal or wood. This, however, causes a problem in that the furnaces burning fluid fuels are not compatible with burning a solid fuel. Accordingly, a separate furnace has to be provided to heat the structure or the fluid fuel burning furnace has to be modified.

Accordingly, it is a primary object of the present invention to provide a method of and apparatus for supplying supplemental heat to a building by burning a solid fuel in the event the supply of fluid fuel is interrupted.

Further, it is an object of the present invention to provide a method of and apparatus for supplying supplemental heat to a building which is normally heated by burning a fluid fuel that permits the additional heat to be supplied without modifying the building.

Further, it is an object of the present invention to provide apparatus for supplying supplemental heat to a building which is normally heated by burning a fluid fuel by positioning the apparatus outside of the building to be heated so that the danger of fire is reduced.

In accordance with the invention, a method of supplying supplemental heat to a building which is normally heated by burning a fluid fuel is disclosed and includes the steps of positioning a furnace disposed within a shelter outside near the building, the shelter having an inlet for receiving air and an outlet for passing air heated by the furnace out of the shelter. An air duct is mounted between the shelter and a window opening into the building. A solid fuel is burned in the furnace to heat the air within the shelter and the heated air is transported through the duct into the building to provide supplemental heat to the building in the event the supply of fluid fuel is interrupted.

Further and in accordance with the invention, apparatus is provided for supplying supplemental heat to a building which is normally heated by burning a fluid fuel and includes a shelter having walls with an inlet for receiving ambient air and an oulet for passing heated air out of the shelter. A furnace is disposed within the shelter for heating the air and includes a grate for supporting a solid fuel to be burned and an exhaust stack extending through the walls of the shelter for exhausting gases from the furnace, the furnace being enclosed so that the exhaust gases from the burning fuel are carried through the stack without mixing with the air in the shelter. A duct adapted to be mounted between the shelter and the window opening within the building is used to carry the heated air passing through the outlet of the shelter into the building to provide heat to the building in the event the supply of fluid fuel is interrupted.

BRIEF DESCRIPTION OF THE DRAWINGS

Other objects and advantages of the invention will become apparent upon reading the following detailed description and upon reference to the drawings, in which like reference characters are used throughout to designate like parts.

While the invention will be described in connection with a preferred embodiment and procedure, it will be understood that it is not intended to limit the invention to that embodiment and procedure. On the contrary, it is intended to cover all alternatives, modifications and equivalents as may be included within the spirit and scope of the invention as defined by the appended claims.

DETAILED DESCRIPTION OF THE INVENTION

Figure 1:
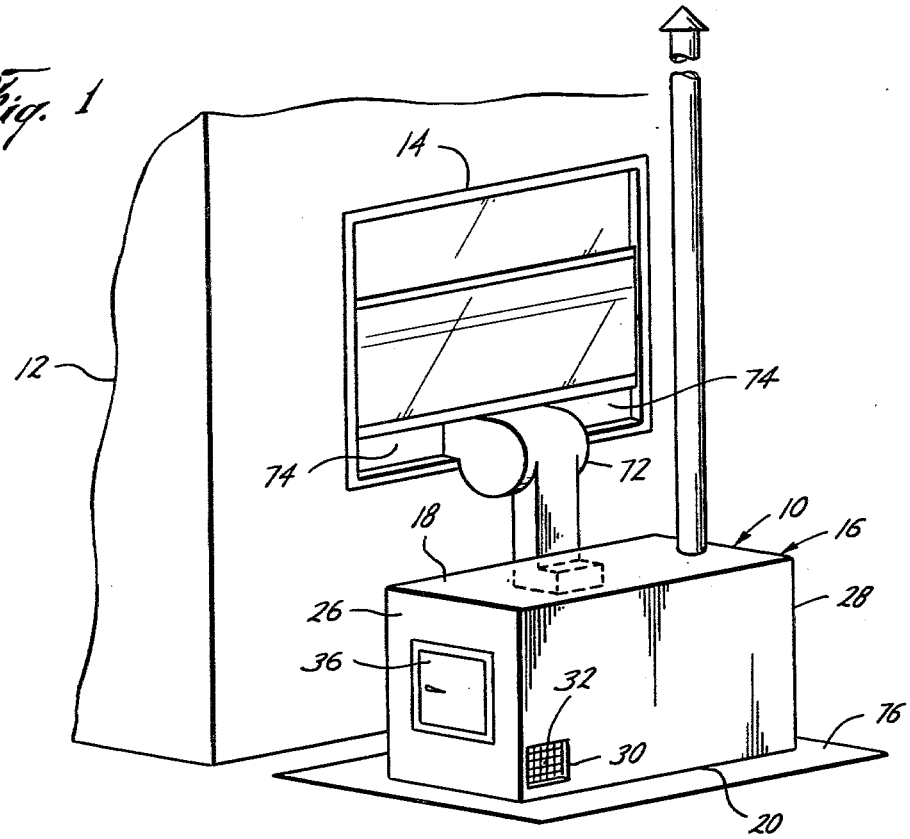
FIG. 1 is a perspective view of apparatus constructed according to the present invention.
Figure 2:
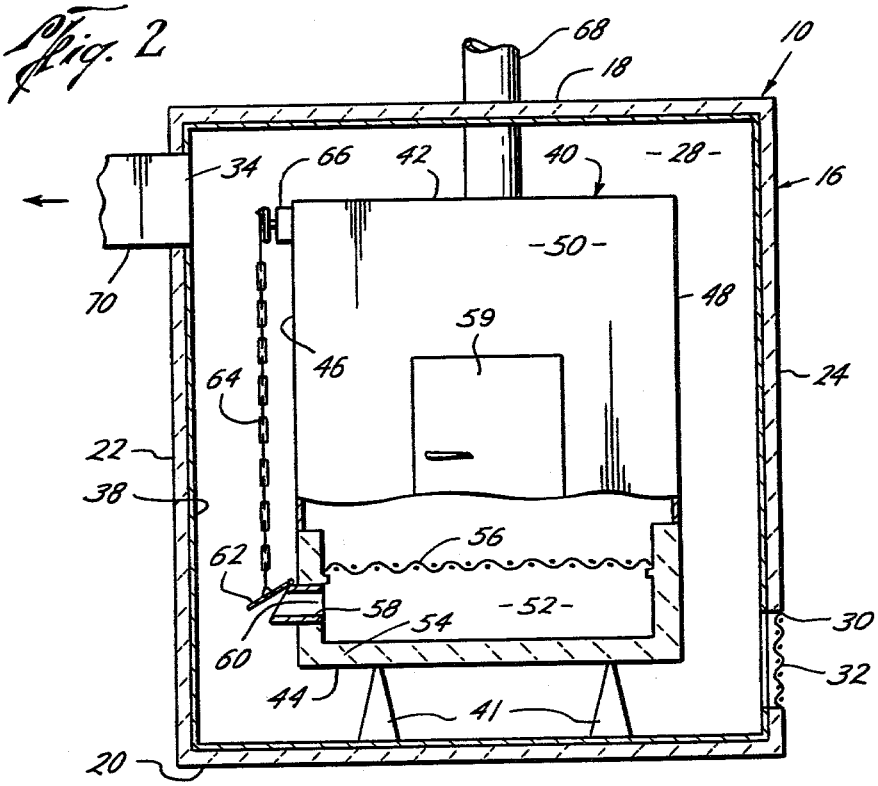
FIG. 2 is an elevational end view, partly in section, of the apparatus shown in FIG. 1.

Turning now to the drawings, there is shown apparatus 10 for supplying supplemental heat to a building 12 which is normally heated by burning a fluid fuel. Apparatus 10 is disposed at any convenient location outside near building 12, as long as the location is near an existing opening 14 into the building. As shown in FIG. 1, the preferred location is near a window.

Apparatus 10 includes a shelter 16, which has a top 18, a bottom 20, an inside wall 22 nearest building 12, an outside wall 24 away from building 12, a front 26 and a back 28. An opening 30 covered by a screen 32 extends through outside wall 24 to act as an inlet for receiving ambient air. An opening 34 extends through inside wall 22 to act as an outlet for passing heated air out of shelter 16. A door 36 covers an access port in front 26 of shelter 16. Preferably, shelter 16 is constructed from an insulating material, such as masonry, to aid in preventing heat loss through the walls of the shelter and a lining 38, such as aluminum, is provided on the inside of shelter 14 for reflecting radiant energy emitted from furnace 40 disposed within the shelter. It is also preferred that inlet 30 be near bottom 20 and front 26 of shelter 14 and that outlet 34 be near top 18 and back 28 to provide the longest possible distance for the air to pass through shelter 14 which aids in heating the air.

Furnace 40 is used to heat the air as it passes from inlet 30 to outlet 34. The furnace is disposed and supported in shelter 16 by conventional apparatus, such as braces 41. As shown, furnace 40 is preferably a boxlike structure having a top 42, a bottom 44 and parallel side walls 46 and 48, which extend from front 50 to back 52. An insulating material 54, such as fire brick, is provided in the bottom portion of furnace 40 to protect the furnace and a grate 56 extends across this bottom portion to support the solid fuel. A door 59 is disposed over an opening in front 50 to permit access into furnace 40 for adding fuel or removing ashes.

A conduit 58 is disposed in the bottom portion of the furnace and within side wall 46 to provide an opening 60 beneath grate 56 which admits air to the burning fuel. A damper 62 is pivotally mounted to the upper edge of conduit 58 to regulate the flow of air through the opening (the draft to the burning fuel). A chain 64 interconnects a conventional thermostat 66, such as a bimetallic thermostat, with damper 62 for controlling the draft to the solid fuel being burned in furnace 40. Preferably, thermostat 66 is at the same height as outlet 34 in shelter 16 to cancel the effect of fuel quality and ambient air temperature to thereby provide a constant temperature at outlet 34.

An exhaust stack 68 is provided in top 42 of furnace 40 and extends through top 18 of shelter 16 so that the exhaust gases from the furnace are removed from shelter 16 without mixing with the air therein. Preferably, this stack extends to a level above the roof of building 12 to inhibit the possibility of fire in the building.

A duct 70 is adapted to be mounted between opening 34 of shelter 16 and window opening 14 into building 17. The heated air, thus, passing through outlet 34 of shelter 16 is carried through duct 70 into building 12 to provide heat to the building in the event the supply of fluid fuel is interrupted. When desired, a blower or fan disposed within a housing 72 is mounted to duct 70 for drawing the air from shelter 16 and into building 12.

A blocking element 74 adapted to the mounted on said duct may be provided in the window opening on each side of the duct to inhibit the passage of any air other than the heated air being carried through the duct into building 12.

In operation, supplemental heat is supplied to building 12, which is normally heated by burning a fluid fuel, by positioning shelter 16 having furnace 40 disposed therein outside near the building 12. A base 76, such as poured concrete, is preferably provided at this location to prevent corrosion and other damage to the shelter. Air duct 70 is then mounted between shelter 16 and window opening 14. Doors 36 and 59 are opened to add solid fuel to furnace 40. The fuel is burned to heat air passing into shelter 16 from inlet 30. The heated air is then transported through outlet 34 and duct 70 into building 12 to provide heat to the building in the event the supply of fluid fuel is interrupted. Blocking elements 74 may be mounted around duct 70 in window opening 14 to inhibit the passage of any air through the window opening other than the heated air transported through the duct into the building.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible elements may be made of the invention without departing from the scope thereof, it is to be understood that all matter herein set forth or shown in the accompanying drawings is to be interpretted as illustrative and not in a limiting sense.

The invention having been described, what is claimed is:

1. A heating system comprising a building to which heat is to be supplied:

a box-like metal shelter postioned on top of the ground adjacent to but entirely outside said building;

a furnace postioned within said shelter and spaced from the interior walls of said shelter thereof to provide an open space between the shelter and furnace for air to flow to be heated by contact with the heated exterior walls of the furnace;

said shelter having a cold air inlet in its lower portion through which air from outside said building can flow into said space to be heated;

an air duct connected to an air outlet at an upper portion of said shelter and to the building through a window therein to conduct heated air from said space into said building;

said furnace having an air inlet thereto through which combustion air can flow into the furnace and an exhaust stack communicating with said furnace and extending to the exterior of the shelter to discharge combustion gases to the atomsphere;

an access door in a side wall of said furnace which when open permits solid fuel to be added to the furnace from the exterior of the shelter and ashes to be removed from the furnace to the exterior of the shelter, all without carrying said fuel and ashes through the building;

said air inlet is provided in a side wall of the shelter near the bottom thereof and wherein said duct is connected to an opposite side wall near the top thereof;

a reflective linging provided on the inside of the top, bottom and side walls of said shelter for reflecting radiant energy emitted from said furnace; and wherein said shelter is constructed from an insulating material to aid in preventing heat loss through said shelter;

a damper connected to said furnace covering an opening beneath a grate for controlling the flow of combustion air through the opening; and a thermostat operably connected to said damper provided within said shelter at substantially the same height as the outlet for regulating the draft to the solid fuel in response to the temperature of the heated air passing out of said shelter.

* * * * *